US008439356B2

(12) United States Patent
Saltsov et al.

(10) Patent No.: US 8,439,356 B2
(45) Date of Patent: May 14, 2013

(54) DRIVE MECHANISM FOR STACKER LINKAGE

(75) Inventors: Leon Saltsov, Thornhill (CA); Mykhaylo Kucherenko, Maple (CA); Sergiy Bukhman, Toronto (CA); Olga Sydorchenko, legal representative, Toronto (CA); Volodimir Barchuk, Toronto (CA); Sergiy Androsyuk, Toronto (CA)

(73) Assignee: Crane Canada Co., Concord, ON (CA)

( * ) Notice: Subject to any disclaimer, the term of this patent is extended or adjusted under 35 U.S.C. 154(b) by 113 days.

(21) Appl. No.: 11/990,593

(22) PCT Filed: Aug. 17, 2006

(86) PCT No.: PCT/CA2006/001350

§ 371 (c)(1),
(2), (4) Date: Nov. 27, 2009

(87) PCT Pub. No.: WO2007/019698

PCT Pub. Date: Feb. 22, 2007

(65) Prior Publication Data

US 2010/0176548 A1 Jul. 15, 2010

(30) Foreign Application Priority Data

Aug. 19, 2005 (CA) ..... 2516551

(51) Int. Cl.
*B65H 29/38* (2006.01)

(52) U.S. Cl.
USPC ..... 271/177

(58) Field of Classification Search ..... 271/177, 271/178, 180, 181; 209/534; 194/206, 207; 187/210, 187/211, 213, 269, 240, 243, 244; 414/796.7, 414/792.7, 793.4, 793.8, 495, 498; 254/122, 254/124, 130
See application file for complete search history.

(56) References Cited

U.S. PATENT DOCUMENTS

| | | | | |
|---|---|---|---|---|
| 5,421,443 | A * | 6/1995 | Hatamachi et al. | 194/206 |
| 5,836,435 | A * | 11/1998 | Fujita et al. | 194/206 |
| 5,876,033 | A * | 3/1999 | Lonati | 271/298 |
| 6,598,871 | B2 * | 7/2003 | Ono et al. | 271/180 |
| 2003/0137095 | A1 * | 7/2003 | Ito et al. | 271/176 |

* cited by examiner

*Primary Examiner* — Thomas Morrison

(57) ABSTRACT

A cassette having a scissor type linkage for displacing a received substrate payment from an initial receiving guide to a storage arrangement is powered by a two bar drive linkage. The two bar drive linkage has one bar connected to said housing and the free end of the other bar member connected adjacent a central pivot of the scissor type linkage. A link member is connected to the pivot connection of the bars to each other with an opposite end connected to a worm driven crank arm. The drive linkage provides a mechanical advantage as a payment substrate is added to the storage arrangement.

11 Claims, 3 Drawing Sheets

DRIVE MECHANISM FOR STACKER LINKAGE

FIELD OF THE INVENTION

The present invention relates to cassettes for banknote acceptors or payment validators which receive a paper substrate for validation and acceptance. In particular, the invention relates to an improved drive mechanism for moving of a stack or mechanism to displace a paper substrate from a receiving slot into a storage area.

BACKGROUND OF THE INVENTION

There are a host of banknote or payment validators which receive a paper substrate and advance the paper substrate through a validation section and if acceptable, move the substrate to a banknote cassette. The banknote cassette includes a stacker mechanism to displace the received banknote into a storage area where the received paper payments are retained in a stacked configuration.

Many of the known banknote or payment cassettes use a scissor type linkage for moving a stacker plate through receiving guides to displace a banknote received in a guide arrangement and move the paper substrate into the storage area to one side of the guide arrangement. An example of the scissor type stacking mechanism is shown in our U.S. Pat. No. 6,241,240. In this patent, a rotary cam is used to control movement of the stacking mechanism and also control movement of the guides to provide a more efficient stripping of the banknote from the guides. Other arrangements merely use the scissor type stacking arrangement to move through the stationary guides.

Various arrangements have been proposed for efficient movement of the stacker plate through the guides and into the storage arrangement. These mechanisms require power particularly when the storage arrangement has received a number of banknotes approaching the capacity of the cassette. Typically the storage area includes a pressure plate having a spring bias for biasing the plate towards the guides. The stacker plate when forced through the guides, overcomes the spring bias and moves the stack of banknotes, and on the return stroke of the stacker mechanism, the spring bias returns the stack to a stop position against the guides. Thus, the stacker mechanism must overcome the spring bias, in combination with the inertia and resistance of the stack of banknotes. The power requirements increase as the cassette approaches its capacity. Furthermore, it can be appreciated that the power variation during the stroke of the stacker plate also varies. The initial power of the stacker plate to move from an initial position to one side of the guides and through the guides is only opposed by any resistance offered by the single banknote being stripped from the guides. Once the stacker plate contacts the stack of previously stored banknotes or paper substrates, then additional power is required.

The prior art has used a number of different arrangements such as a gear train for driving of the stacker plate or a rotary cam arrangement as shown in our earlier patent or a push actuator projecting from the rear surface of the cassette. It is desirable to operate the stacker plate with a relatively low power drive to reduce the cost of the banknote acceptor and the cassette. It is also desirable to have a space efficient, relatively narrow drive to maximize the storage compartment. Typically, a banknote validator will have several banknote cassettes to allow withdrawal of a full cassette and insertion of an empty cassette. Therefore, it is desirable to have a cassette that can be manufactured in a cost effective manner.

The present invention provides an improved drive linkage associated with the scissor type mechanism for stacking of a paper substrate received in the guides.

SUMMARY OF THE INVENTION

A cassette for receiving and storing a substrate payment such as a banknote or coupon comprises a housing having a slot opening for longitudinally receiving a substrate payment with the slot opening including within the housing two opposed guides positioned on opposite sides of the housing to receive and support the substrate payment as it passes through the slot into the housing. A displaceable stacker plate is provided in an initial position located to one side of the two guides. The cassette includes storage arrangement to a side of the guides opposite the stacker plate. The storage arrangement receives therein substrate payments displaced from the guide members by the stacker plate to form a stack of substrate payment in the storage arrangement. The drive arrangement for controlled movement of the stacker plate includes a scissor type linkage having a pair of arms connected at an intermediate pivot. The scissor type linkage is connected to the stacker plate and the housing for moving the stacker plate from the initial position through the guides to a substrate payment stripping position within the storage arrangement. The drive arrangement further includes a drive linkage with two bar members pivotally connected to each other. A free end of one of the bar members is pivotally connected to the housing and a free end of the other bar member is pivotally connected to the scissor type linkage. The drive linkage in the initial position of the stacker plate has the bar members forming a substantially overlapped orientation and movable to an extended position forcing the stacker plate to the banknote stripping position.

According to an aspect of the invention the bar member connected to the scissor type linkage is pivotally connected to the intermediate pivot of the pair of arms.

According to a further aspect of the invention the drive linkage includes a bar link member connected to the pivot of the two bar members with a free end of the link member connected to a rotary crank arm.

According to a further aspect of the invention the crank arm and link member form a generally perpendicular angle therebetween when the stacker plate is in the extended position.

In yet a further aspect of the invention the crank arm cooperates with the link member and the scissor linkage to provide a mechanical advantage for a worm drive used to rotate said crank arm and moves said stacker plate through the guides to the substrate payment stripping position.

In yet a further aspect of the invention, the two bar members of the drive linkage are of different lengths with the bar member attached to the housing being greater in length than the bar member attached to the scissor type linkage.

According to a further aspect of the invention, the drive linkage in the initial position of the stacker plate has said two bar members forming an acute angle therebetween at the pivot of said arms and movable to the extended position forming an obtuse angle between the two bar members when the stacker plate is in the substrate payment stripping position.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
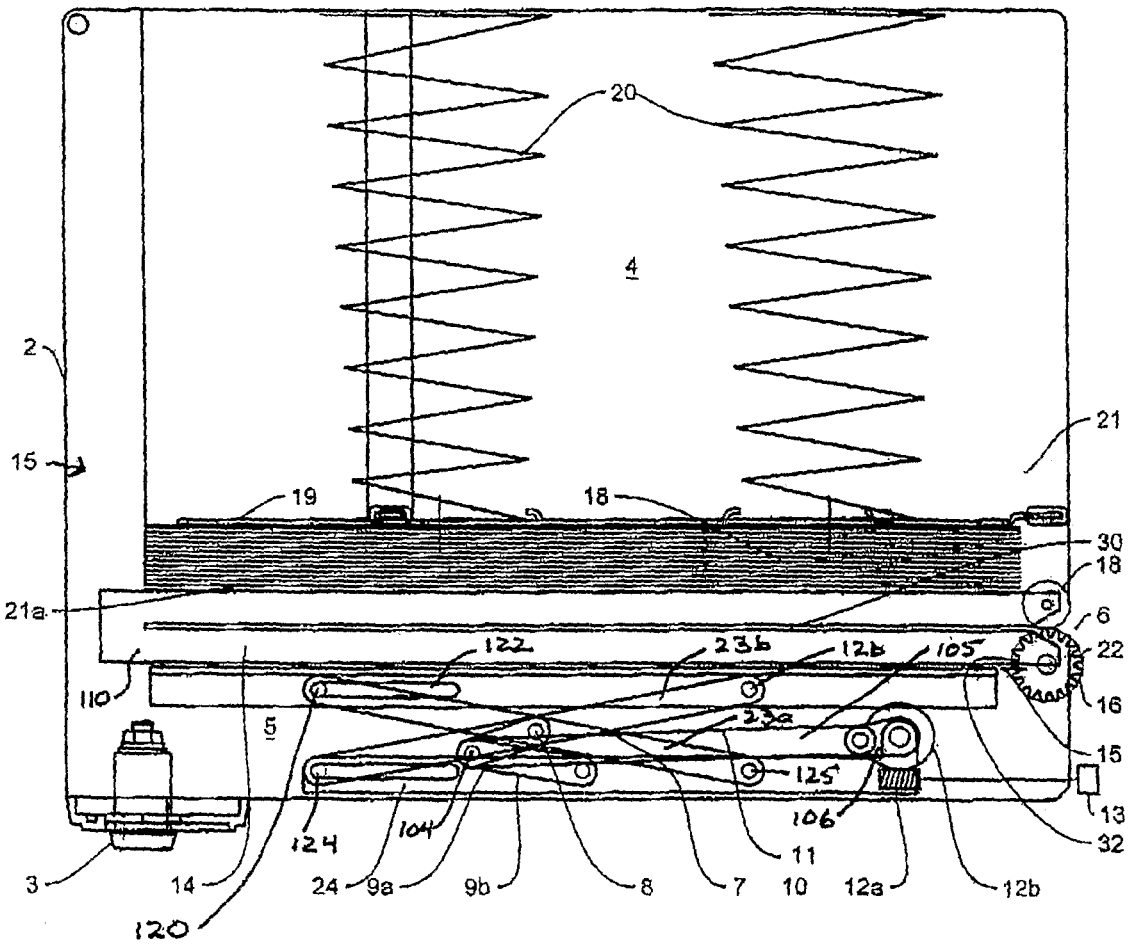
FIG. 1 is a sectional view through a banknote cassette showing the stacking mechanism to one side of a storage area.
Figure 2:
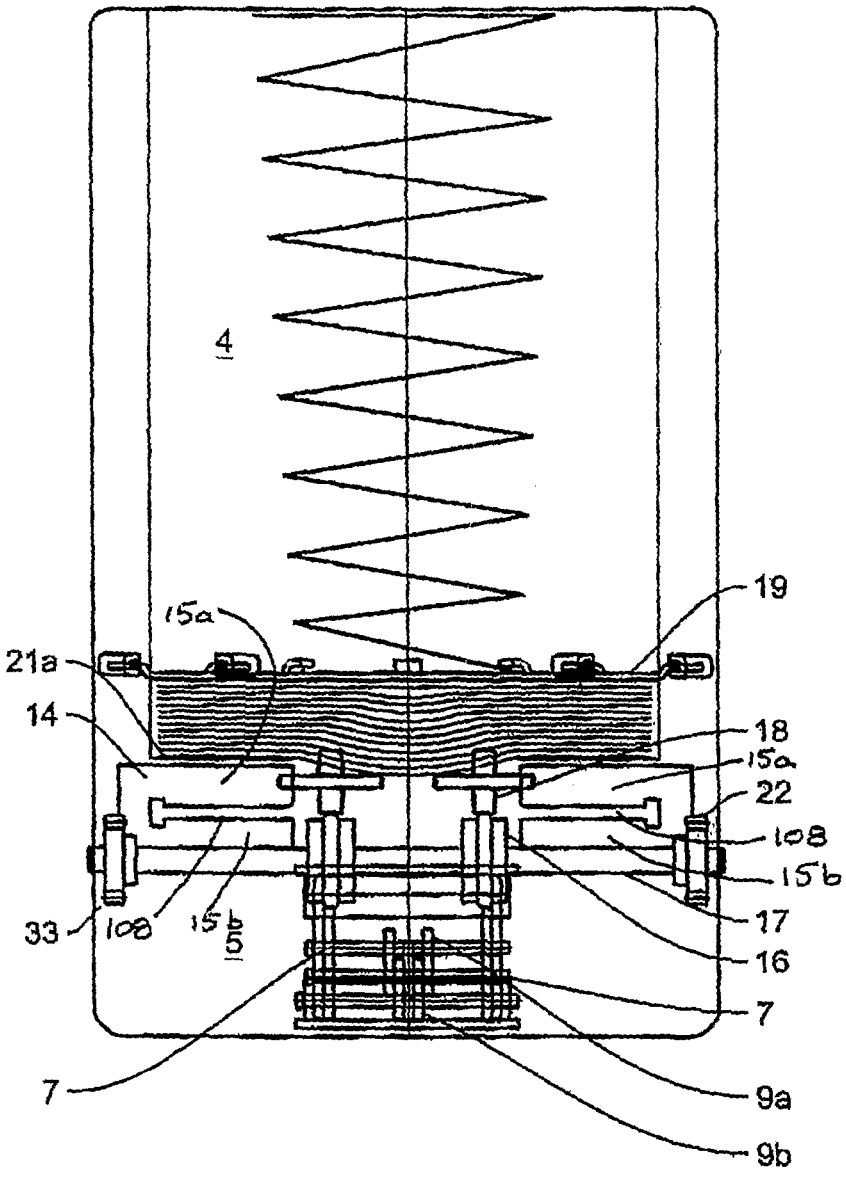
FIG. 2 is a sectional end view of the banknote cassette.

As shown in FIGS. 1 and 2, a currency cassette comprises a housing or casing 1 with an access door 2 and lock arrangement 3 at one end of the cassette. The cassette includes a storage chamber 4 and an intake chamber 5 provided with the opposed guide members 6. A double scissor type linkage 7 is positioned within the intake chamber 5 and controls the position of the stacker plate 100.

A drive linkage 102 comprises bar members 9*a* and 9*b* with link 9*b* pivotally secured to the casing and link 9*a* pivotally secured to the central pivot shaft 8 of the scissor type linkage. Bar members 9*a* and 9*b* are pivotally secured to one another at 104.

A connecting link 11 is attached to the pivot location 104 of links 9*a* and 9*b* with a free end 105 of the connecting link 11 pivotally attached to a crank arm 106. Crank arm 106 is driven by a gear 12*b* which is in mesh with the spiral worm gear 12*a*. The spiral worm gear 12*a* is driven by a power gear 13. The power gear 13 cooperates with a drive of the banknote acceptor for selective powering of the stacking mechanism. The power for moving the stacker mechanism is provided by a drive motor that is part of the banknote acceptor as opposed to a motor in the cassette.

The plastic guides 14 can be separately molded guides or can include a common connection base. Each of the guides has opposed walls 15*a* and 15*b* which define a payment substrate receiving slot 108 therebetween. As shown in FIG. 1, the guide arrangement 14 includes a base portion 110 for providing a stop surface for a payment substrate such as a banknote or paper substrate.

Feed rollers 16 on a common axis 17 cooperate with pressure rollers 18 for receiving a banknote and feeding of a banknote into the guide arrangement 14. Once a banknote has been received within the banknote cassette, the stacking mechanism 120 will strip the banknote from the guide arrangement 14 and add the substrate to the stack of banknotes 18 provided within the storage chamber 4.

Within the storage chamber 4, a pressure plate 19 is engaged by a spring bias 20 to maintain the stack of banknotes against the rear surface of the guide arrangement 14. Other arrangements for maintaining the stack of banknotes can be provided.

Figure 3:
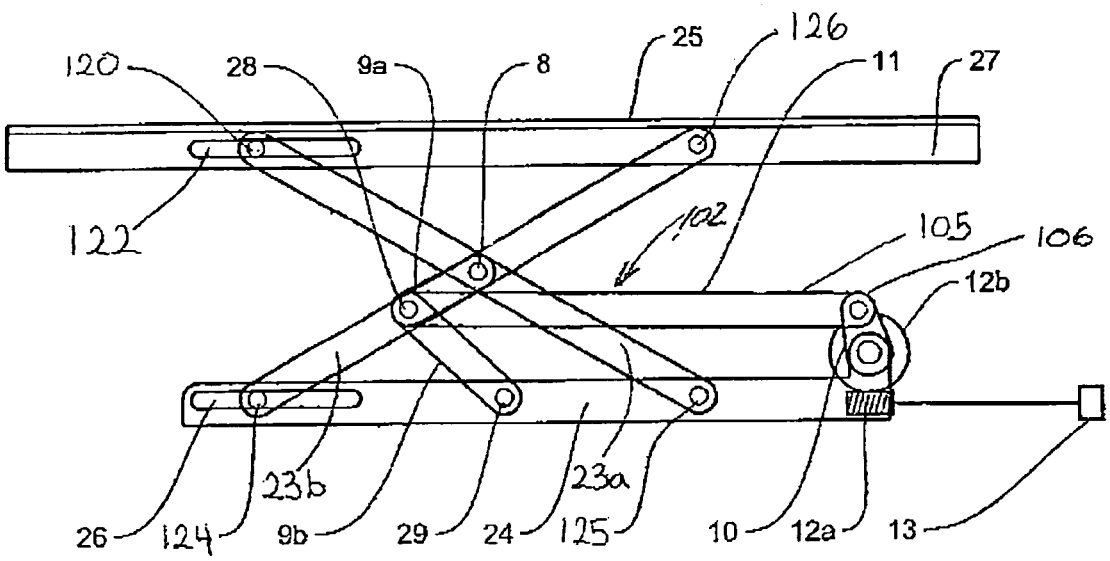
FIG. 3 is a side view showing the scissor type linkage and drive linkage.

FIG. 1 shows an initial position of the scissor type linkage and drive linkage whereas FIG. 3 shows a substrate payment stripping position of the scissor type linkage caused by the drive linkage being moved the extended position.

In FIG. 1 the drive linkage is in a substantially folded orientation and in FIG. 3, the drive linkage has moved to the open orientation.

As shown in FIG. 2, the stacker plate 25 is controlled by two opposed scissor linkages 7. The scissor linkages are connected by a common shaft 8. A single drive linkage defined by the bar members 9*a* and 9*b* is provided between the two scissor type linkages and is connected to the common shaft 8. A link member 11 is connected to the pivot securement 28 between the bar members 9*a* and 9*b*. The opposite end of the link member 11 is pivotally connected to the crank arm 106 and the crank arm is driven by the worm drive 12*a* in mesh with the gear 12*b* which is directly connected to the bank arm 106. The drive linkage and link member 11 uses the space between the scissor linkages and does not interfere with movement of the scissor linkages.

As shown in FIG. 1, the crank arm 106 rotates from a position generally aligned with the link member 11 to the extended position of FIG. 3 where the link member 11 and the crank arm 106 forms an angle closer to perpendicular. During initial movement of the scissor type linkage 7, the amount of power required is relatively low as there is essentially no opposition to movement of the scissor type linkage other than initial resistance to movement by the scissor type linkage itself. The link member 11 pulls on the pivot connection 104 to cause the drive linkage to go from the substantially overlapped condition of FIG. 1 to the extended position of FIG. 3. The angular relationship of the crank arm, the link member 11, and the drive linkage in the initial position is not favourable from a power consideration, however, little initial power 13 is required.

The links 9*a* and 9*b* provide a mechanical advantage in moving the scissor type linkages when movement of these linkages is being opposed by the stack of banknotes and the spring bias 20. Thus, the mechanical advantage of the drive linkage in combination with the mechanical advantage of the crank arm and the link member 11 provide more power at the appropriate position of the scissor type linkage when the drive linkage is moving to the extended position. Once the drive linkage has caused the scissor type linkage to move to the extended position of FIG. 3, any banknote provided in the banknote receiving slot 108 has been fully stripped and any stack of banknotes has been moved away from the guide members such that the stripped banknote has cleared the walls 15*a* of the guide members. The worm drive can then be reversed in direction to return the scissor type linkage to the initial position of FIG. 1. As can be appreciated, the worm drive provides an accurate mechanism for providing accurate control of the drive linkage.

The double type scissor type linkage comprises a base plate 24 attached to the cassette housing 1. A pusher plate 25 is connected to the base plate 24 in parallel relation by the pair of scissor type linkages 7. These scissor type linkages move the pusher plate 25 toward or away from the base plate 24 in parallel relation thereto. Each scissor type linkage 7 comprises two slide levers 23*a* and 23*b* pivotally connected by a common shaft 8. One end of the guide levers 23*a* is pivotally connected to the base plate 24 by pivot connection 125 supported without longitudinal movement but for hinged movement of the link lever 23*a*. The other end of the link lever 23*a* is pivotally connected to the pusher plate 25 for rotation and longitudinal movement by shaft 120 received within an elongated slot 122 of a flange 27 attached to the pusher plate 25.

The other link lever 23*b* is connected to the base plate 24 for rotation and longitudinal movement by a shaft 124 received within an elongate slot 26 of the base plate 24 attached to the cassette wall. The other end of link 23*b* is pivotally connected to the pusher plate 25 by a pivot connection 126 supported without longitudinal movement but for hinged movement. The two scissor linkages are connected by shaft 120, shaft 124 and shaft 8.

The two bar element drive linkage comprises the two bar members 9*a* and 9*b* attached by the common pivot location 28. The free end of bar member 9*a* is pivotally connected to the middle pivot shaft 8 of the scissor type linkages. An opposite end of member 9*b* is pivotally connected to the base plate 24 by shaft 29. Pivot 28 is linked with a crank arm 10 by the connecting link member 11. Rotation of the crank arm causes the connecting link member to move in a parallel like manner to the base plate 24. The motion of the pivot 28 causes reciprocal motion of the pusher plate 25 as indicated. The crank 10 as rotated by the worm gear transmission comprises the worm gear 12*a* and the gear 12*b*.

As shown in FIG. 3, the crank arm 106, year 12*b*, the scissor linkages 7, the drive linkage 9*a* and 9*b*, and the link member 11 are all commonly supported on the base plate 24. The base plate is connected to the container wall.

The guide arrangement 14 with the stop wall 21*a* comprises a lengthwise central window with a width about one third of the widest note to be received. Each pressure roller 18 is pressed against the drive roller 16 by a suitable spring arrangement.

The particular drive linkage preferably has a two bar linkage where the ratio of the length of one bar to the length of the other bar is 1.5 to 1.7. The longer length bar is pivotally connected to the cassette housing to provide the desired mechanical amplification.

This type of structure has been described with respect to a note validator or other banknote or currency handling device that requires stacking of a substrate to one side of a receiving guide arrangement. These devices are useful in banks, postal facilities, super markets, casinos, or transportation facilities. This particular drive arrangement can also be used for receiving other substrates such as cards, films, paper sheets, or printed substrates.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A cassette for receiving and storing banknotes comprising a housing having a slot opening for longitudinally receiving a banknote at one end of said housing with said slot opening being adjacent a back face of said housing, said slot opening including within said housing two opposed guides positioned on opposite sides of and extending in a length of the housing adjacent said back face to receive and support a payment substrate as it passes through said slot into said housing, a displaceable stacker plate in an initial position located to one side of the two guides and between said guides and said back face, said cassette including a storage arrangement to a side of said guides opposite said stacker plate and opposite said back face, said storage arrangement receiving therein payment substrates displaced from said guide members by said stacker plate to form a stack of payment substrates in said storage arrangement, a drive arrangement for controlled movement of said stacker plate;

said drive arrangement including a scissor type linkage having a pair of elongate arms extending in the length of said housing and connected at an intermediate pivot, said scissor type linkage extending in said length of said housing and being connected to said stacker plate and said housing for moving said stacker plate from said initial position through said guides to a payment substrate stripping position within said storage arrangement;

said drive arrangement further including a drive linkage with two bar members pivotally connected to each other with a free end of one bar member pivotally connected to said housing at said back face and a free end of the other bar member pivotally connected to said scissor type linkage;

said drive linkage in said initial position of said stacker plate having said bar members generally extending in the length of said housing and forming a substantially folded orientation within a space occupied by said scissor type linkage and movable to an extended position forcing said stacker plate to said payment substrate stripping position, said bar members forming an opened orientation therebetween when said stacker plate is in said payment substrate stripping position; and wherein said drive linkage includes a separate link member extending in said length of said housing and in a space intermediate said scissor type linkage with one end of said separate link member pivotally connected to said drive linkage and an opposite end connected to a driven crank arm located adjacent said slot opening at said one end of said housing, said crank arm cooperating with said separate link member to control movement of said stacker plate from said initial position to said payment substrate stripping position.

2. A cassette as claimed in claim 1 wherein said bar member connected to said scissor type linkage is pivotally connected to the intermediate pivot of said pair of arms of said scissor type linkage and in said initial position extends in the length of said housing in a direction away from said slot opening.

3. A cassette as claimed in claim 1 wherein said separate link member is connected to said drive linkage adjacent the pivot connection of said bar members to each other.

4. A cassette as claimed in claim 3 wherein said separate link member is connected to the pivot connection of said bar members.

5. A cassette as claimed in claim 4 wherein said two bar members of said drive linkage are of different lengths with said bar member connected to said housing being of a longer length.

6. A cassette as claimed in claim 5 wherein the ratio of the length of said two bar members is in the range of 1.5 to 1.7.

7. A cassette as claimed in claim 3 wherein said scissor type linkage is a pair of connected scissor linkages and said separate support link member is located between said pair of connected scissor linkages.

8. A cassette as claimed in claim 1 wherein said crank arm is driven by a worm drive engaging a gear portion provided on a pivoted end of said crank arm.

9. A cassette as claimed in claim 1 wherein said crank arm and said separate link member form a generally perpendicular angle therebetween when said stacker plate is in said extended position.

10. A cassette as claimed in claim 1 wherein said crank arm, said separate link member and said drive linkage cooperate to provide an increasing mechanical advantage as said stacker plates moves through said guides and towards said payment substrate stripping position.

11. A cassette as claimed in claim 1 wherein said scissor type linkage in said initial position extends in said length of said housing and occupies a shallow depth behind said stacker plate;

said drive arrangement being located within said shallow depth behind said stacker plate.

* * * * *